United States Patent [19]

Goodwin

[11] Patent Number: 4,712,411

[45] Date of Patent: Dec. 15, 1987

[54] APPARATUS FOR MAKING A FORGED METAL ARTICLE

[75] Inventor: Roy S. Goodwin, St. Thomas, Canada

[73] Assignee: Clevite Industries Inc., Glenview, Ill.

[21] Appl. No.: 863,290

[22] Filed: May 15, 1986

[51] Int. Cl.[4] ..... B21D 45/02; B21K 1/30

[52] U.S. Cl. ..... 72/344; 72/354; 72/359; 419/28

[58] Field of Search ..... 72/354, 358, 359, 344, 72/342; 29/159.2, DIG. 31; 425/78, 352–355; 419/28

[56] References Cited

U.S. PATENT DOCUMENTS

| | | | |
|---|---|---|---|
| 3,108,502 | 10/1963 | Chatfield | 72/354 |
| 3,258,834 | 7/1966 | Rork | 29/159.2 |
| 3,370,450 | 2/1968 | Scheucher | 72/354 |
| 3,394,432 | 7/1968 | Laurent | 425/78 |
| 3,694,127 | 9/1972 | Takahashi et al. | 425/78 |
| 3,891,367 | 6/1975 | Signora | 425/78 |

FOREIGN PATENT DOCUMENTS

| | | | |
|---|---|---|---|
| 16159 | 10/1962 | Japan | 29/159.2 |
| 20941 | 5/1981 | Japan | 72/352 |
| 134230 | 8/1982 | Japan | 72/377 |
| 56436 | 4/1985 | Japan | 72/344 |
| 667313 | 6/1979 | U.S.S.R. | 72/354 |

*Primary Examiner*—Lowell A. Larson

*Attorney, Agent, or Firm*—Russell E. Baumann

[57] ABSTRACT

The present invention provides an apparatus for producing in a single stroke a forged metal article with a helical contoured surface. The apparatus uses an upper punch with a generally smooth surface which is telescopically received in a punch housing and a lower punch of generally smooth surface which is mounted for free rotation with respect to the axis of the die assembly. This design allows for the use of a die of the general configuration and length of the finished article which is economical and efficient to operate.

3 Claims, 5 Drawing Figures

APPARATUS FOR MAKING A FORGED METAL ARTICLE

BACKGROUND OF THE INVENTION (a) Field of the Invention

This invention relates to an apparatus for making a metal article and more particularly, an apparatus for making a fully dense forged metal article having an intricate contoured surface.

(b) Description of the Prior Art

Metal parts having contoured surfaces, for example, gears having a plurality of teeth have been produced by machining a block of metal with the desired contoured surface, or by powder metallurgy techniques in which metal particles are compacted into the desired contoured surface and the compact is sintered. If a powdered metal technique is used a complex tooling apparatus is often required and tool wear has been typically excessive. Additionally, the resulting metal article has had relatively lower physical properties due to having a density less than fully dense material. In cases in which good physical properties are required, such as many gear applications, the articles have to be produced by machining a block of solid metal. This process, however, results in an article which is expensive to produce.

Lastly, there are many advantages associated with the use of metal articles produced by powder metallurgy techniques, for example, the ability to readily vary the powder metal composition to provide particular characteristics, and the ability to form intricate contours while minimizing or avoiding machining operations.

It would be advantageous if metal articles having intricate contoured surfaces and good physical properties could be produced using an apparatus which is reliable and economical in operation.

SUMMARY OF THE INVENTION

It is an object of this invention to provide an apparatus for producing a forged, metal article with a contoured surface.

It is a further object of this invention to provide an apparatus for producing a forged fully dense metal article with an intricate contoured surface in a single stroke operation in which the article is made from a powdered metal.

It is still a further object of this invention to provide an apparatus for producing a forged fully dense metal article with a helical contoured surface in a single stroke operation.

In accordance with the invention there is provided an apparatus for producing in a single stroke a forged metal article with a contoured surface comprising: a die assembly having a die passage therethrough and a die having a profiled surface in said assembly; upper and lower punch assemblies, said die assembly being disposed between said punch assemblies, said upper punch assembly comprising an upper punch housing, a first forging punch mounted in said housing and a tubular punch sleeve surrounding said first punch, means for axially reciprocating said upper housing relative to said die assembly to reciprocate said first punch and sleeve with respect to said die assembly, said sleeve being slidably mounted in said upper housing for axial telescopic retraction into said upper housing relative to said first punch, said lower punch assembly including a second forging punch extending into said die passage in opposed relationship with said first punch, said second punch being adapted to support an article to be forged in said die assembly, and means for axially raising said second punch in said die passage to eject a forged article from said die assembly.

In accordance with another aspect of the invention there is provided an apparatus for producing a fully dense forged, metal article with a helical contoured surface comprising: a die assembly having a die passage therethrough, a die having a profiled surface seated in said passage, and first and second forging punches mounted for opposed axial movement in said die passage, said punches having no helical form incorporated therein.

In this specification the expressions "contoured surface" and "profiled surface" particularly contemplate surfaces having a plurality of ridges and furrows or some similar pattern of ribs and grooves, whether straight or not; by way of example there may be mentioned the surface of a gear, sprocket or spline.

In this specification the expression "contoured surface" is employed to define the surface of a forged metal article of the invention, for example, a gear; and the expression "profiled surface" is employed to define the surface of a die which is to form the "contoured surface". Thus the "contoured surface" of the article and the "profiled surface" of the die are complementary or mating surfaces.

BRIEF DESCRIPTION OF THE DRAWINGS

The invention is illustrated in a particular and preferred embodiment by reference to the accompanying drawings in which.

DESCRIPTION OF PREFERRED EMBODIMENTS WITH REFERENCE TO THE DRAWINGS

Figure 1:
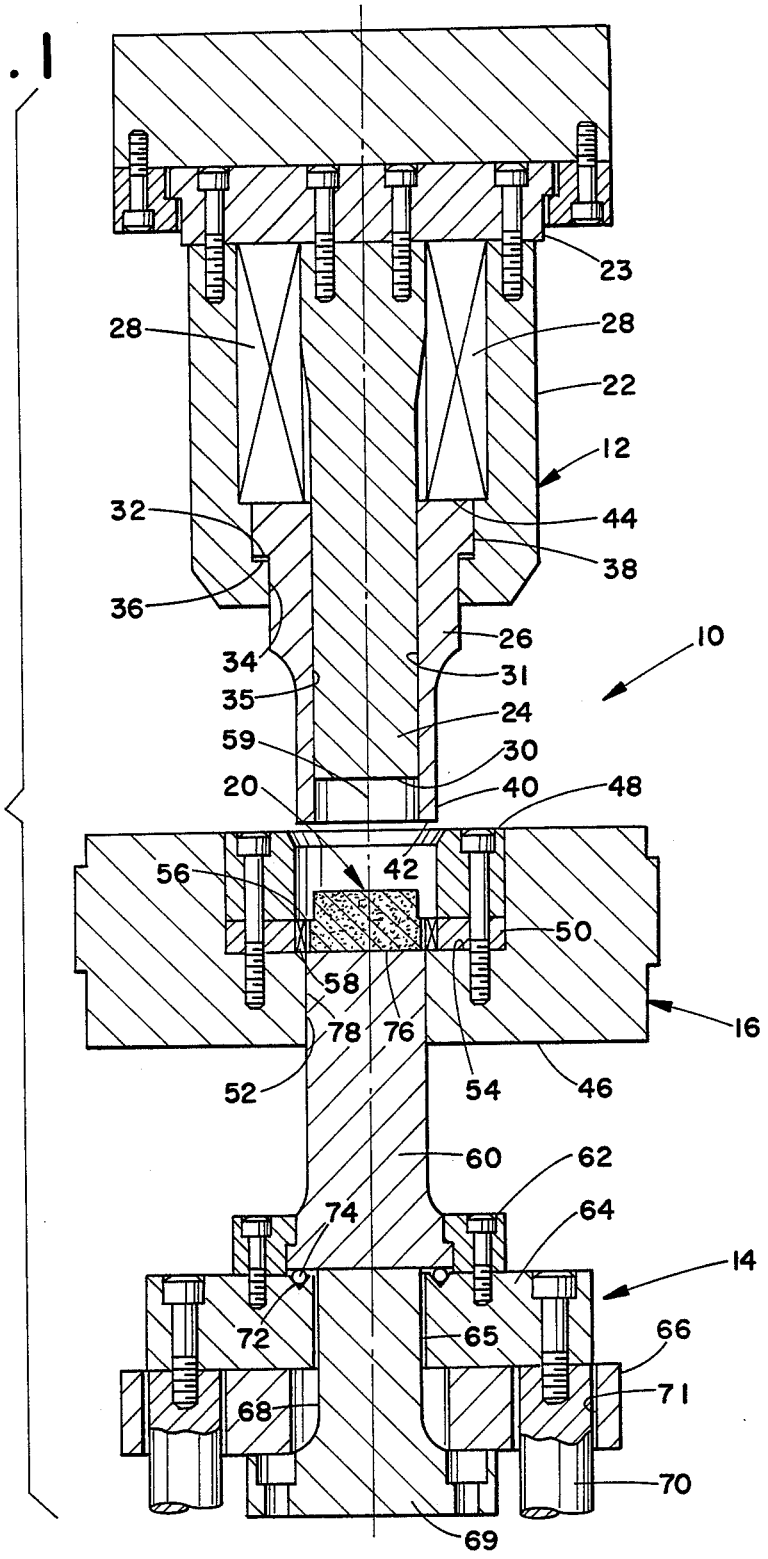
FIGS. 1, 2 and 3 illustrate schematically an apparatus of the invention at different stages of the method of the invention for producing a forged metal article, particularly a helical gear of the invention.
Figure 2:
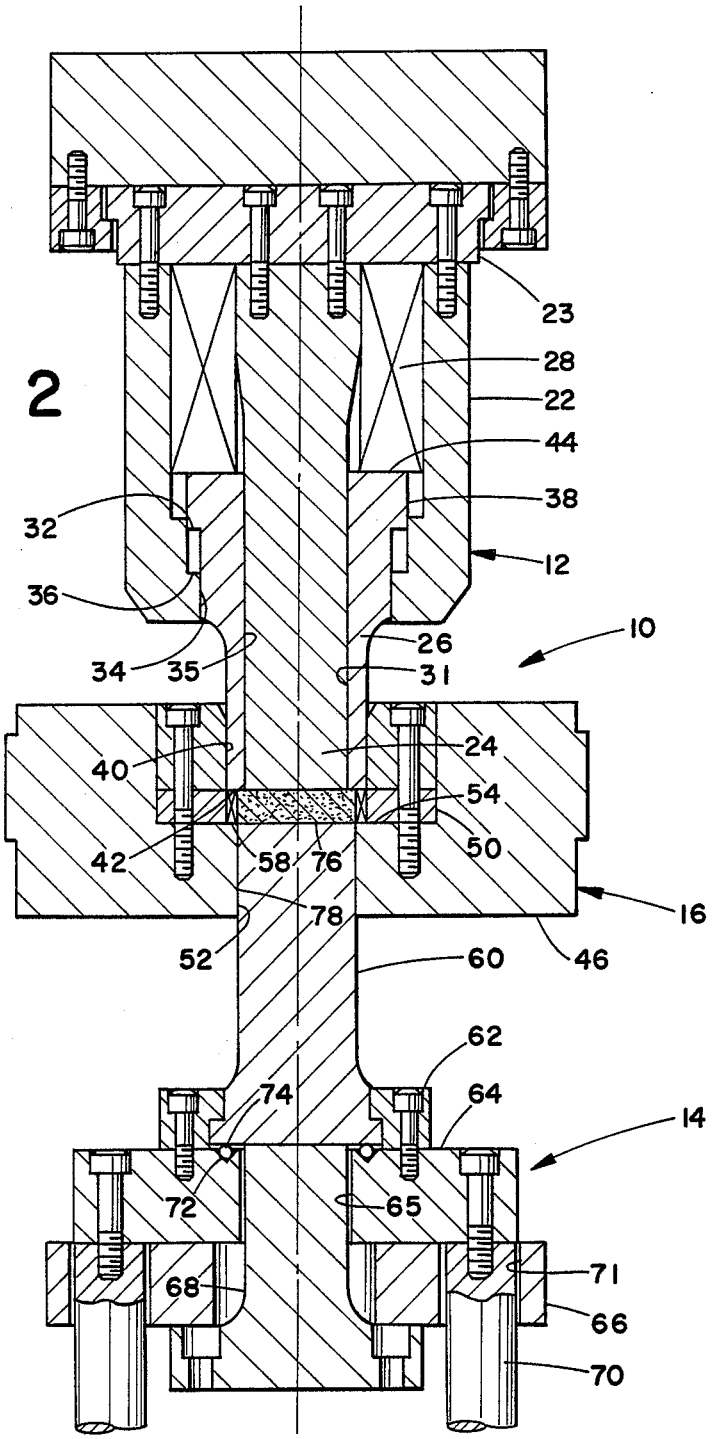
Figure 3:
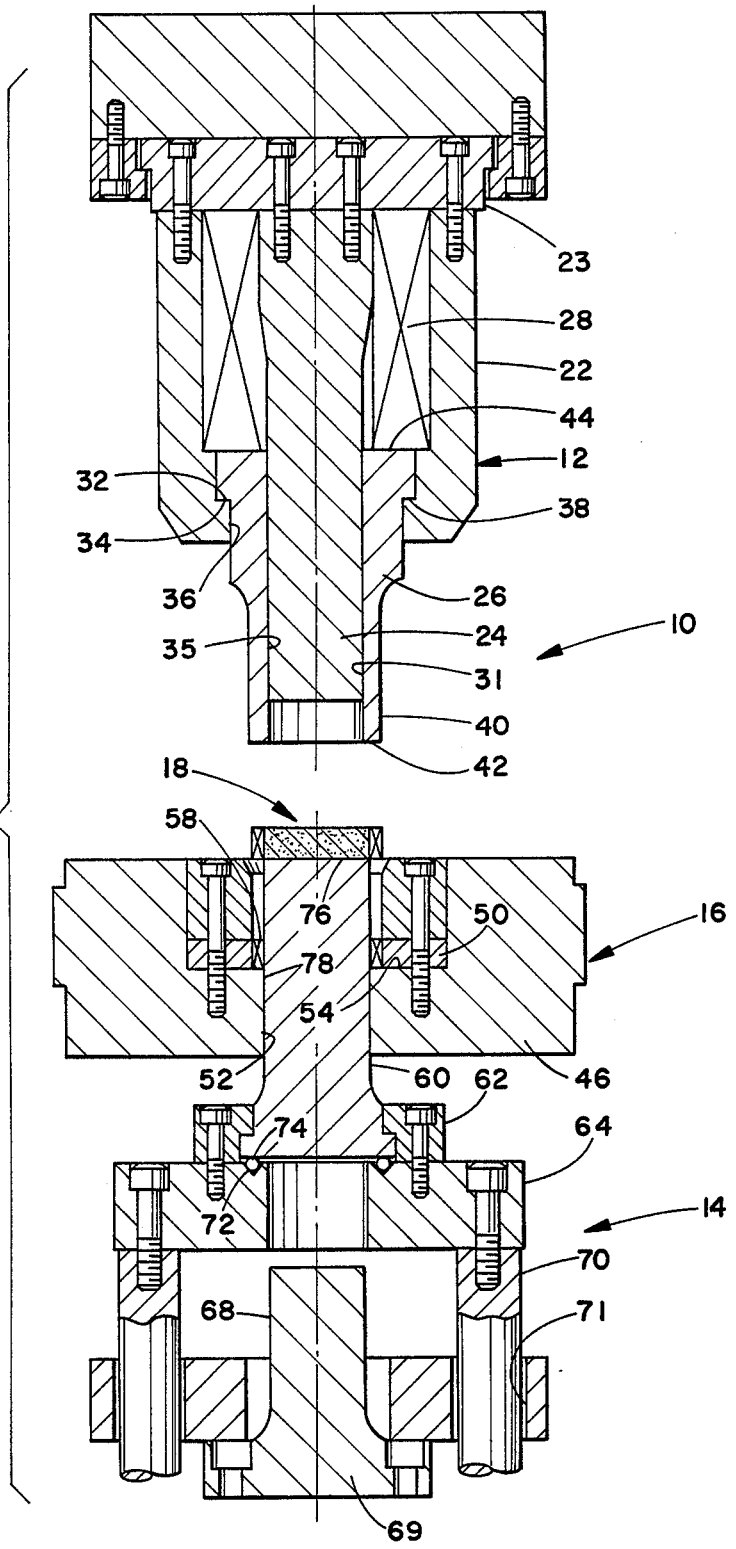

With further reference to the drawings, FIGS. 1 to 3 show an apparatus 10 for producing a forged metal article 18 in accordance with the invention. FIGS. 1, 2 and 3 show the apparatus in sequential stages of the method of the invention. FIG. 1 illustrates a loading step, FIG. 2 illustrates a forging step and FIG. 3 illustrates an ejection step.

With further reference to FIGS. 1 to 3, apparatus 10 includes an upper punch assembly 12, a lower punch assembly 14 and a die assembly 16 therebetween.

With particular reference to FIG. 1, a sintered powder metal preform 20 is shown supported in die assembly 16 and with reference to FIG. 3, a forged article 18 is shown being ejected. It is to be understood that metal preform 20 may also be made of solid metal material.

Upper punch assembly 12 includes a punch housing 22, a forging punch 24 and a punch sleeve 26. Housing 22 and forging punch 24 are fixedly mounted to a base 23.

Spring means 28 are disposed in housing 22 between base 23 and an inner end 44 of punch sleeve 26. This spring means will typically take the form of actual spring or hydraulically loaded biasing means.

Forging punch 24 includes a generally flat forging surface 30 and a smooth cylindrical surface 31.

Sleeve 26 includes a shoulder 32, an outer slide surface 34 and an inner tubular wall 35.

Housing 22 includes a flange 36 and a cylindrical guide surface 38.

Sleeve 26 further includes an outer locating end 40 having a flat annular surface 42.

Die assembly 16 includes a die casing 46, a die clamping ring 48 and a die plate 50.

Die passage 52 extends through assembly 16.

Die casing 46 includes an annular seat 54 on which die plate 50 is mounted by means of clamping ring 48. Any convenient means, for example, screws, may be employed to lock die plate 50 in annular seat 54 with clamping ring 48.

Die plate 50 has an inwardly facing profiled surface portion 58 which circumscribes preform 20 and a vertical impact axis 59. An annular cavity or space 56 is defined between profiled surface 58 and preform 20.

Profiled surface 58 particularly comprises a plurality of extending ridges and furrows. If the final forged article 18 is to be a helical article these ridges and furrows will be inclined at an angle relative to axis 59.

Lower punch assembly 14 includes a forging punch 60 mounted by punch clamp ring 62 including a punch adaptor 64.

Punch adaptor 64 has a cylindrical passage 65 therethrough which receives a cylindrical rod 68 having a cylindrical flange base 69 of lower base plate of apparatus 10. Flange 69 and punch 60 support the load during the forging operation. A shim plate 66 is located on flange base 69.

A pair of ejection rods 70 is disposed to slide through ejector passages 71 in shim plate 66 to engage the underside of adaptor 64.

Adaptor 64 preferably has an annular groove 72 circumscribing cylindrical passage 65, containing ball bearings 74 or the like which support forging punch 60 during ejection for free rotation relative to clamp ring 62 and adaptor 64.

Forging punch 60 has a generally flat support surface 76 and a smooth cylindrical surface 78.

Figure 4:
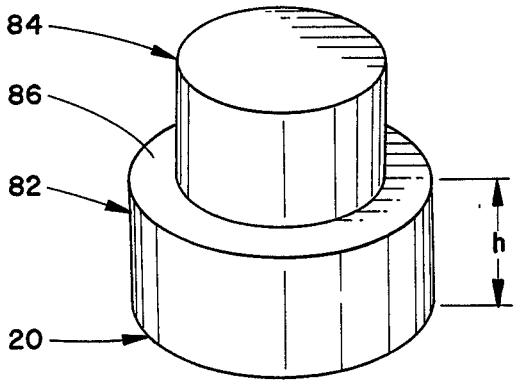
FIG. 4 shows schematically the preform for the helical gear employed in FIG. 1.

With further reference to FIG. 4, preform 20 has a cylindrical body 82, a cylindrical head 84 and a shoulder 86. Cylindrical body 82 has a height h. It is to be understood that shape of preform 20 may take other forms.

Figure 5:
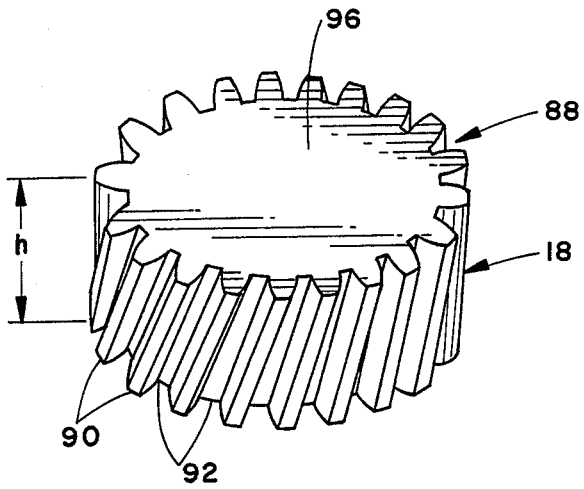
FIG. 5 shows the forged article produced in the stage illustrated in FIG. 3.

With further reference to FIG. 5, a forged, powder metal article 18 has a generally cylindrical body 88 with a plurality of inclined ridges 90 separated by furrows 92 on its circumferential surface. Forged article 18 includes a generally flat surface 96.

Body 88 has a height h which is substantially the same as the height h of body 82 of preform 20 in FIG. 4.

In the method of the invention, a metal part which typically will be cylindrical to provide a preform 20 is illustrated in FIG. 4. The dimensions of the preform 20 are selected having regard to the dimensions of the forged article 18 desired. Thus the body 82 of preform 20 typically has a height h corresponding generally to the height h of the forged article 18 desired. The dimensions of cylindrical head 84, and of the shoulder 86 are selected so that cylindrical head 84 will be matingly received within tubular wall 35 adjacent locating end 40 of sleeve 26, and annular surface 42 of locating end 40 will engage the shoulder 86 to locate preform 20 securely in position in preparation for impact by forging punch 24.

In the operation of the apparatus 10, forging punch 60 extends vertically upward in die passage 52 and preform 20 is supported on flat supporting surface 76 so that the cylindrical body 82 of preform 20 is surrounded by and spaced inwardly of profiled surface 58 of die plate 50.

The profiled surface 58 of die plate 50 has generally a height h corresponding to the height h of cylindrical body 82. An annular cavity or space 56 is preferably provided between profiled surface 58 and cylindrical body 82.

Upper punch assembly 12 is supported above die assembly 16 with punch 24 in opposed relationship with punch 60.

Punch sleeve 26 is urged downwardly of housing 22 by spring means 28, with slide surface 34 of sleeve 26 in sliding engagement with guide surface 38 of housing 22, until shoulder 32 of sleeve 26 engages flange 36 of housing 22. In this configuration illustrated in FIG. 1, forging surface 30 of punch 24 is spaced inwardly of annular surface 42 of sleeve 26, and vertically above head 84 (see FIG. 4) of preform 20; and annular surface 42 is vertically above shoulder 86 (see FIG. 4).

In the forging step particularly illustrated by reference to FIGS. 1 and 2, upper punch assembly 12 including housing 22, sleeve 26 and forging punch 24 is moved vertically downwardly until cylindrical head 84 is contained within locating end 40 of sleeve 26, and the annular surface 42 of locating end 40 engages shoulder 86. With continued travel of punch assembly 12 downwardly, sleeve 26 is retracted within housing 22, while maintaining engagement between annular surface 42 and shoulder 86. During such retraction slide surface 34 of sleeve 26 slides against guide surface 38 of housing 22. It is to be understood that other means could be used to close off profiled surface 58 as punch 24 engages preform 20.

With the retraction of tubular guide 26 into housing 22, tubular wall 35 of sleeve 26 slides against cylindrical surface 31 of punch 24. Forging surface 30 of punch 24 impacts cylindrical head 84 to effect forging lateral flow of metal of preform 20 into the only space available, namely, annular cavity or space 56, and die space so that the metal flows laterally to engage the profiled surface 58 of the die. There is thus formed in the cylindrical body 82 a contoured surface which matches the profiled surface 58 of die plate 50.

As the metal flows laterally into contact with the profiled surface 58, the metal is cooled by contact with the die plate 50.

On completion of the impacting or forging step the punch assembly 12 is raised as shown in FIG. 3 whereafter sleeve 26 is telescoped out of housing 22 under the action of springs 28.

In order to eject the forged article 18, ejector rods 70 are slid upwardly through ejector passages 71 of shim plate 66, to engage the underside of adaptor 64, whereby adaptor 64 is elevated with forging punch 60. With its elevation, punch 60 rotates, if needed, on bearings 74 as the ridges and furrows 90 and 92 of the forged article 18 slide vertically with respect to the corresponding furrows and ridges of the profiled surface 58.

The forged article 18 more particularly shown in FIG. 5 may thereafter be machined as desired.

The invention is further illustrated by reference to the following Description of the Preferred Embodiments and Example.

DESCRIPTION OF THE PREFERRED EMBODIMENTS

The invention has particular application in the production of ferrous metal gears, especially helical gears in which the contoured surface is relatively complex, and the invention is further described by reference to such application. It is to be understood, however, that it would work equally well for nonferrous metal articles such as copper and brass metals.

In carrying out the method of the invention to produce a gear of powder metal, a ferrous metal powder is blended to a homogeneous mix with any desired additives, for example, alloying metals in powder form, graphite and lubricants as is known in the art.

The blended powder is compacted to form a cylindrical compact in conventional manner and then typically sintered to form a preform.

The sintered preform is heated to an elevated temperature suitable for the forging operation, by way of example a temperature of 950° to 1250° C. The die preferably is likewise heated but to a lower temperature by way of example 275° to 355° C., such that the sintered metal flowing under the forging impact pressure and cools on contact with the die.

The appropriate temperatures will depend in part on the composition of the sintered metal.

The heated preform is supported in a die cavity such that a body portion is spaced radially inwardly of an annular die having a profiled inner surface, the body portion and the profiled surface being in opposed relationship; suitably the body portion and annular die have their centers coincident on the same vertical axis.

The heated preform is forgingly impacted by driving a forging punch under high pressure, by way of example 25 to 75 tsi, into contact with the cylindrical head of the preform, in particular by driving the punch along the vertical axis.

As part of the forging step the head is snugly received in a retractable punch sleeve which isolates the head for impact by the forging punch and prevents lateral flow of the metal in the head. The sintered metal in the head flows downwardly under the forging impact into the body and then laterally outwardly from the body into the space between the body and the die and then to mate with the profiled surface.

The laterally flowed metal cools on contact with the die and is ejected easily from the die.

The punch surfaces are smooth, non-profiled surfaces and the die has the sole profiled surface. This feature provides for longer tool life and greatly simplified tool design.

A forged powder ferrous metal article produced in accordance with the invention will typically have a strength of at least on the order of 150,000 to 200,000 psi, and a yield of the order of 135,000 to 155,000 psi.

In the case of the production of a helical gear in which the profiled surface of the die and the resulting contoured surface of the gear both comprise helically inclined ridges and furrows, ejection of the forged article requires relative rotation of the forged article and the die. This is achieved by supporting the preform and subsequently formed forged article in the die cavity on a vertically upstanding forge punch mounted for free rotation about its axis. Ejection of the forged article is carried out by elevating the upstanding forge punch and allowing it to rotate relative to the die.

EXAMPLE

A ferrous powder was blended with 0.5% by weight of graphite and 0.75% by weight of a lubricant to form a homogeneous mix.

The ferrous powder mix was compacted in a die to a density of 6.4 g/cc to form a solid cylindrical preform.

The preform was sintered in a sintering belt furnace at a temperature of 1121° C. for 10 minutes in an atmosphere of rich endothermic gas.

The thus sintered preform was machined to a stepped diameter preform 20 as shown in FIG. 4, so that, by reference to FIGS. 1 to 4, the head 84 (FIG. 4) had a slightly smaller diameter than the diameter of the tubular wall 35 and the forging punch 24; and the cylindrical body 82 had a diameter corresponding to the diameter of the forging punch 60. The cylindrical body 82 had a height h generally corresponding to the height of the profiled surface 58 of die plate 50. The profiled surface had a helix angle of 22°.

Die plate 50 was heated to a temperature of 315° C. and sprayed with a lubricating mixture of water and graphite.

The preform 20 was similarly lubricated with a mixture of water and graphite, and heated to a temperature of 1065° C. in a tube furnace having an atmosphere of rich endothermic gas.

The preform 20 was supported on punch 60 in the die assembly 16 as shown in FIG. 1, and was forged under impact of forging punch 24 at a pressure of 40 tsi as illustrated in FIG. 2.

It was found that the resulting forged article cooled quickly as a result of the contact with the die plate 50. Forging punch 60 was elevated by means of the ejection rods 70, and rotated during elevation on bearings 74 to elevate the forged article 18 out of the die assembly 16.

The floor 96 was partially machined out of article 18 to produce a helical gear with a contoured surface of teeth and channels having a helix angle of 22°.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

I claim:

1. An apparatus for producing in a single stroke a forged metal article with a helical contoured surface comprising:

a die assembly having a die passage there-through and a die having a helical profiled surface in said assembly, upper and lower punch assemblies, said die assembly being disposed between said punch assemblies, said upper punch assembly comprising an upper punch housing, a first forging punch mounted in said housing and a punch sleeve surrounding said first punch, means for axially reciprocating said upper housing relative to said die assembly to reciprocate said first punch and sleeve with respect to said die assembly, said sleeve being slidably mounted in said upper housing for axial telescopic retraction into said upper housing relative to said first punch, said lower punch assembly including a second forging punch extending into said die passage in opposed relationship with said first punch, said second punch being adapted to support an article to be forged in said die assembly and having mounting means allowing for free rotation with respect to the axis of the die assembly, said upper and lower punches having a generally smooth surface with no helical form incorporated therein, and means for axially raising said second punch in said die passage to eject a forged article from said die assembly.

2. An apparatus according to claim 14 wherein said article is made from a powdered metal.

3. An apparatus according to claim 1 wherein said die is of essentially the same length as the finished article.

* * * * *